United States Patent [19]

Elliott

[11] B 3,984,792

[45] Oct. 5, 1976

[54] PRECISE COAXIAL ATTENUATOR FOR PICOSECOND PULSES

[75] Inventor: Brian John Elliott, Yorktown Heights, N.Y.

[73] Assignee: International Business Machines Corporation, Armonk, N.Y.

[22] Filed: July 31, 1974

[21] Appl. No.: 493,370

[44] Published under the second Trial Voluntary Protest Program on March 16, 1976 as document No. B 493,370.

[52] U.S. Cl. ..... 333/81 A; 324/188; 328/54; 328/65

[51] Int. Cl.[2] ..... H01P 1/22

[58] Field of Search ..... 333/20, 81 R, 81 A, 333/97 R; 307/237; 328/54, 59–61, 65; 324/188

[56] References Cited

UNITED STATES PATENTS

| | | | |
|---|---|---|---|
| 2,720,631 | 10/1955 | Hall | 333/97 R |
| 3,668,416 | 6/1972 | Marilleau | 333/20 X |
| 3,723,912 | 3/1973 | Thatch | 333/20 |
| 3,778,732 | 12/1973 | Wang | 328/65 X |

*Primary Examiner*—Paul L. Gensler
*Attorney, Agent, or Firm*—Joscelyn Cockburn; John W. Henderson

[57] ABSTRACT

A coaxial attenuator, for attenuating baseband picosecond pulses with Fourier components in the high microwave frequency range and for calibrating pulse measuring instruments, is disclosed. A fast pulse, propagating along the attenuator, is split into two waves at a transition plane formed by an intermediate tubular conductor and an outer conductor. The purpose of the transitional plane is, in addition to splitting the incoming wave, to attenuate the wave. One of the attenuated waves propagates along the inside of the conductor of the intermediate section to a pulse measuring instrument for viewing. The other attenuated wave is delayed before propagating along the same intermediate conductor to be viewed on said viewing device. The known time lag between the two wavefronts is used for time calibrating pulse measuring instruments.

2 Claims, 4 Drawing Figures

FIG. 1
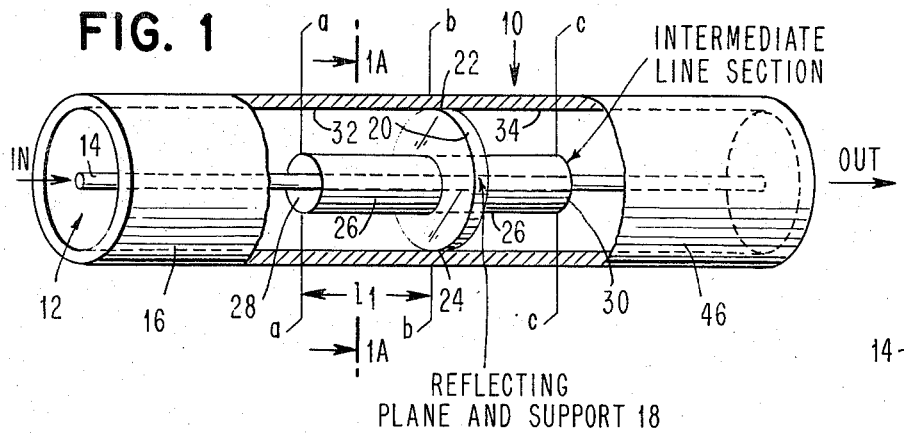
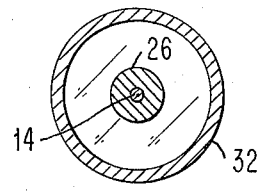
FIG. 1A
FIG. 2
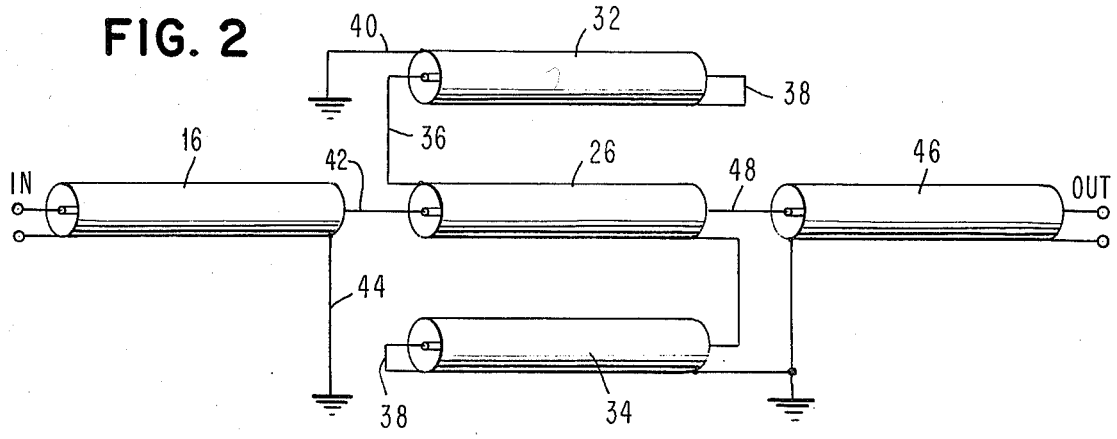
FIG. 3
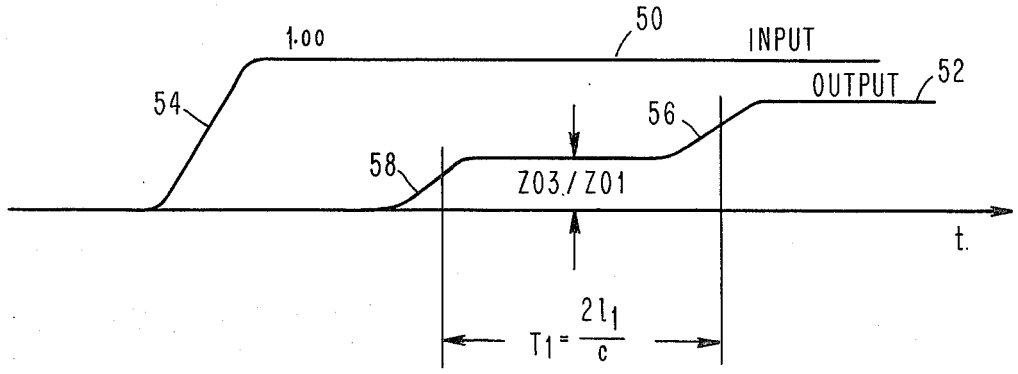

PRECISE COAXIAL ATTENUATOR FOR PICOSECOND PULSES

BACKGROUND OF THE INVENTION

1. Field of the Invention

This invention relates to apparatus for attenuating waves, and more particularly, to coaxial attenuators for attenuating baseband pulses with components in the microwave frequency range.

2. Prior Art

The use of coaxial attenuators for attenuating high frequency waves is well known in the art. In all the prior art coaxial attenuators resistive elements, in some form or other, are inserted between the inner conductor and the outer conductor and in series with the inner conductor. These elements attenuate the pulses as they are propagated along the coaxial line. There are several configurations of these prior art coaxial resistive attenuators, such for example, as the T-pad attenuator and the line type attenuator. Each type of the presently-used attenuators has basic limitations which will be presently explained and with which the present invention is concerned.

The T-pad attenuator consists of a series of fixed resistive elements of T-formation, which gives a definite attenuation with a constant input and output impedance, depending upon the resistance values selected. However, there is a condition that the individual resistive elements will stay constant in value only below the frequencies where the wave length is long compared to the physical dimension of the resistors. When this condition fails, the value of the resistors, and therefore attenuation of the unit, will change with frequency. As a result of this change, the T-pad attenuator cannot be used for attenuating pulses with components in the high microwave frequency range. In fact, the best T-pad attenuator has a cut-off frequency of approximately 10 GHZ. However, in several applications, for example, laboratory experiments, it is necessary for one to obtain the attenuation of pulses with components in the high microwave frequency range (up to approximately 100 GHZ) and due to the limitation discussed above, the T-pad attenuator is not satisfactory.

Another type of resistive attenuator is the so-called line type attenuator, also known as the distributive type attenuator. In this type of attenuator, the inner conductor of the coaxial line is replaced with a resistive element, so that the field of wave traveling down the coaxial line is attenuated because part of the energy is dissipated in the resistive elements. With the line type attenuator, waves can be attenuated to a higher frequency (20 GHZ) than the T-pad type attenuator, although not as high as one would disire. However, there is a low frequency limit due to the length of the resistive element compared with the wave length; in this case, the length of the resistive element should be long compared with the wave length. Due to the limitation of the line type attenuator in attenuating waves in the lower and the upper frequency ranges, the device is essentially a narrow band device and is useless for very wide band applications.

Still another type of resistive attenuators is the so-called card-type attenuator. Basically, the card-type attenuator consists of a flat insulating plate, usually of ceramic material, having a thin conductive or resistive coating on at least one surface thereof, which coating acts as the attenuating element. Although this attenuator attenuates wave to a lower frequency range than the line type attenuator, it has the same limitation as the T-pad type attenuator, i.e., inability to accurately attenuate very fast pulses. The failure to attenuate waves, uniformly with frequency, in the high microwave frequency range stems from the fact that the disk type attenuator has stray reactive elements, for example, capacitive components, which results in a change in attenuation with increased frequency (a result which can be regarded as principally due to the effect of the ceramic disk).

In addition to the inability of the prior art attenuators to attenuate waves in the high microwave frequency range, (i.e., up to and above 100 GHZ); the pulse waveforms which are attenuated by the prior art attenuators are distored, i.e., the pulse waveforms after attenuation are changed in shape. In fact, the best available coaxial attenuators have a band width from DC up to some 20 GHZ. The corresponding step response risetime is about 20 psec with typical ± 10% overshoot and ringing. For precise picosecond pulse measurements, these specifications are inadequate. This stems from the fact that the resistive elements of the prior art attenuators are not constant in frequency, i.e., as the frequency range is increased, the prior art attenuators are plagued by the effects of the stray elements (series inductance, shunt capacitance, etc.) which changes the effective value of the resistive element and as such, accurate attenuation is not achieved.

OBJECTS OF THE INVENTION

It is, therefore, the object of the invention to attenuate pulses, with components in a higher frequency range with a coaxial attenuator, in a more efficient manner than has heretofore been possible.

It is still another object of the invention to attenuate picosecond pulses over a broader frequency range than has heretofore been possible.

It is a further object of the invention to attenuate pulses without distorting them.

It is still a further object of the invention to time calibrate a pulse measuring instrument with a coaxial attenuator.

The foregoing and other objects, features and advantages of the invention will be apparent from the following, more particular description of the preferred embodiment of the invention, as illustrated in the accompanying drawings.

SUMMARY OF THE INVENTION

The present invention discloses a coaxial attenuator which utilizes a transition from one to two concentric coaxial transmission lines to achieve pulse attenuation. The attenuator includes a main coaxial transmission line having an inner conductor and an outer conductor. A solid metallic washer, having a central opening, is affixed to the inner wall of the outer conductor. An intermediate conductor is positioned concentric with the inner conductor and passes through the opening in the washer and forms a first transitional plane and a second transitional plane with the outer conductor. These transitional planes are the planes at which the pulses traveling along the coaxial line are attenuated.

In addition to attenuating the wave, the first transitional plane splits the wave into two waves. One wavefront is propagated along the inside of the intermediate conductor and is viewed on an instrument to be time calibrated. The other wavefront is delayed a predetermined time and is then propagated along the intermediate conductor to the same instrument. The time lag between the two arriving wavefronts is used to calibrate the viewing instrument.

IN THE DRAWINGS

FIG. 1 is a perspective view of the preferred coaxial attenuator of the present invention.

FIG. 2 is an equivalent circuit of the preferred attenuator.

FIG. 3 is a view of the input waveform and the output attenuated waveform.

FIG. 1A is a cross-section of the attenuator taken along line 1A—1A.

DETAILED DESCRIPTION

A preferred embodiment of my precise coaxial attenuator for attenuating picosecond pulses is depicted in FIG. 1 and generally designated 10. As can be seen from FIG. 1, in order to disclose the critical elements of my invention, I have shown a breakaway view of the attenuator displaying internal elements. Basically, the attenuator includes a main coaxial transmission line (hereinafter referred to as "transmission means") 12. Transmission means 12 is cylindrical and comprises an inner metal conductor 14 and an outer metal conductor 16. Conductor 14 and conductor 16 are of equal lengths. The input of the coaxial attenuator 10 is designated "IN" and the exit from the coaxial attenuator is designated "OUT."

Still referring to FIG. 1, in order to reflect the pulse wavefront to a TEM wave traveling down attenuator 10, I have provided a solid metal washer 18 (hereinafter referred to as "reflecting means"). Reflecting means 18 is manufactured from good conducting metal; for example copper, and is positioned midway between the input and exit end of attenuator 10. Reflecting means 18 has finite thickness and is rigidly affixed to the outer conductor 16 at first contact point 22 and at a second contact point 24. In addition to the reflecting function, reflecting means 18 supports an intermediate line section (which will be subsequently described) and lends strength to the entire structure. The plane formed by reflecting means 18 is referred to as "reflecting plane *b-b*".

Still referring to FIG. 1: in order to attenuate the input pulse which is a TEM wave propagating along attenuator 10, I have provided attenuating means designated at the plane "*a—a*." Attenuating means *a—a* is a transitional plane, containing the junction of three coaxial lines, which splits the TEM wave into two separate, but distinct waves, so that one wave travels along the inside of the intermediate coaxial line section 26 (hereinafter called "intermediate conductor") and the other wave travels along the outer conductor 32. Intermediate conductor 26 is a thin-walled, metal tubular conductor having ends 28 and 30. As stated previously, reflecting means 18 supports intermediate conductor 26. Intermediate conductor 26 is substantially concentric to outer conductors 16 and 32 and is concentric with inner conductor 14. The inner conductor 14, together with the intermediate conductor 26,, and the outer conductor 32, is arranged to form a three-conductor concentric coaxial transmission means. A cross-section along line 1A-1A of the concentric coaxial transmission means is shown in FIG. 1A. It should be noted that the outer conductor is divided in two sections by attenuating means *a—a*. The section of the outer conductor which is left of attenuating means *a—a* is designated 16 and the section of the outer conductor right of attenuating means *a—a* is designated 32. Attenuating means *a—a* is formed by end 28 of intermediate conductor 26 and the outer conductor. The wall thickness of intermediate conductor 26 is thin as it can possibly be made. In an ideal construction, the walls of the intermediate section would approach zero and the attenuation would be essentially perfect, i.e., the attenuated wave would be distortion free (except for the residual effects of the small conductor losses).

Similarly, end 30 of intermediate conductor 26 forms a transitional plane *c—c* with conductor 34 analogous to plane *a—a*. As stated previously, reflecting means 18 supports intermediate conductor 26. It is positioned to be equi-distance from end 28 and from end 30 of intermediate conductor 26. The distance from end 28 to reflecting means 18 is designated $l_1$. As will be explained subsequently, $l_1$ determines the time lag between pulse wavefronts at the output of the device. The delay or time lag in the pulse wavefront is used for absolute time calibrating a pulse measuring instrument. By varying $l_1$, various values of time calibration can be obtained.

Now referring to FIG. 2, an equivalent circuit of the pulse attenuator of FIG. 1 is shown. FIG. 2 demonstrates the electrical characteristics of the coaxial attenuator with conventional circuit elements when a TEM pulse wavefront is propagated from left to right. FIG. 2 also highlights the basic advantage that the preferred invention of FIG. 1 has over the known prior art attenuators that are suitable for use with picosecond pulses. The difference is that, whereas the prior art attenuators use discrete circuit elements and, as such, are subjected to stray circuit elements (series inductance, shunt capacitance, etc.) whose presence limits the risetime and reduces the band width of such attenuators; the present invention (FIG. 1) has, in effect, substantially no stray elements.

The critical point of analysis begins at attenuating means *a—a* where the input wave gets transferred from 1 to 2 coaxial transmission lines. At attenuating means *a—a*, the two transmission means are outer conductor 32 and intermediate conductor 26. Outer conductor 32 has characteristic impedance $Zo_2$ and intermediate conductor 26 has characteristic impedance $Zo_3$. Outer conductor 32 is interconnected in series with intermediate conductor 26 by interconnecting lead 36. As noted previously, reflecting means 18 is a good conductor and is shown in FIG. 2 as lead 38 which is a short circuit. Outer conductor 32, which is also a portion of outer conductor 16 is grounded through interconnecting lead 40. Outer conductor 16, which is to the left of attenuating means *a—a*, has characteristic impedance $Zo_1$ and is interconnected through lead 42 to intermediate conductor 26. Conductor 16 is grounded through interconnecting lead 44.

Similarly, at plane *c—c* output conductor 46, with characteristic impedance Zoo, is interconnected through lead 48 to intermediate conductor 26. Intermediate conductor 26 is in series with conductor 34 and conductor 34 has characteristic impedance $Zo_2'$.

Referring again to FIG. 1, it should be noted that plane *a—a* (attenuating means) effectuates a transition from one (input conductor 16) to two coaxial transmission lines (outer conductor 32, and intermediate conductor 26). The arrangement is such that intermediate conductor 26 is the inner conductor of outer conductor 32 and the intermediate conductor 26 is also the inner conductor of input conductor 16. This arrangement affords a perfect connection and, hence, constant attenuation with frequency. In addition, intermediate conductor 26, in conjunction with reflecting means 18, divides attenuator 10 into discrete equivalent transmission lines as depicted in FIG. 2.

Referring now to FIG. 3, a trace of the step function input and output pulse waveform is shown. As shown in FIG. 3, (time is plotted on the horizontal axis while any conventional unit may be plotted on the vertical axis, for example, voltage or current. Input waveform 50 represents a typical picosecond pulse wavefront prior to attenuation by attenuator 10. Any conventional fast pulse generator may be used to generate the waveform, for example, a tunnel diode (step function) generator. Output waveform 52 represents input waveform 50 after it has been attenuated by attenuator 10. By comparing the leading edge 54 of input waveform 50 with the leading edge 58 of output waveform 52, it can be shown experimentally that there is no measurable distortion in the shape of the wavefront. The theoretical attenuation factor $Zo_3/Zo_1$ will be derived subsequently. As noted previously, the device described herein is suitable for attenuating the fastest available pulses. In an experiment with the device, an attenuation of 11db was obtained. The wavefront degradation is very small (less than 2% broadening which corresponds to the resolution limit of the measuring system for 28 psec. risetime pulses), which implies a risetime of less than about 5 psec. The corresponding band width is large, (greater than 100 GHZ) and the observed pulse top overshoot and distortion is small (less than 2%).

As was previously mentioned and is shown in FIG. 3, attenuator 10 can be used for absolute time calibration of very fast (e.g., 100 picosecond) oscilloscope time bases. A pulse wavefront on reaching plane a-a, FIG. 1, splits into a first and a second pulse wavefront. Due to distance designated $l_1$ between plane *a—a* and reflecting means 18, a time delay equivalent to $(2l_1/c)$ is introduced between the two pulse wavefronts (see FIG. 3). This delay is used for absolute time calibrating a pulse measuring instrument. By varying $l_1$, various time calibrating scales can be obtained on the pulse instrument.

A mathematical derivation of the attenuation factor for the attenuator 10 will now be given. As was previously mentioned, the attenuation factor is $Zo_3/Zo_1$, where $Zo_3$ is the characteristic impedance of the transmission line formed by conductor 14 and conductor 26, and $Zo_1$ is the characteristic impedance of the line formed by conductor 14 and conductor 16. It is assumed that the wall thickness for intermediate conductor (tube) 26 approaches 0. It is also assumed that $l_1$ is the line length between *a—a* and reflecting means 18 (FIG. 1). It is further assumed that c is the pulse velocity along the lines. Let the incident waveform on $Zo_1$ at *a—a* (FIG. 1) be $v_1(t)$, where the pulse length of $v_1(t)$ is less than $(2l_1/c.)$ Then the total voltage across $Zo_2$ in series with $Zo_3$ is given by the use of the transmission coefficient at the junction plane, where the load impedance is $Zo_2 + Zo_3$ and the driving line impedance is $Zo_1$ viz.

$$\frac{2(Zo_2 + Zo_3)\, v_1(t)}{Zo_1 + Zo_2 + Zo_3}.$$

Now $Zo_3$ and $Zo_2$ in series divide the voltage so that the traveling voltage on $Zo_3$ becomes:

$$\frac{Zo_3}{(Zo_2 + Zo_3)} \cdot \frac{2\,(Zo_2 + Zo_3)}{(Zo_1 + Zo_2 + Zo_3)} \cdot v_1(t) = \frac{2\, Zo_3 \cdot v_1(t)}{(Zo_1 + Zo_2 + Zo_3)}.$$

Similarly, the transmission coefficient at plane *c—c* for this signal is $$\frac{2\, Zo_1}{(Zo_1+Zo_2+Zo_3)}.$$

The product leads to the overall attenuation factor for the pulse attenuator:

$$\frac{v_2(t)}{v_1(t)} = \frac{4\, Zo_1\, Zo_3}{(Zo_1+Zo_2+Zo_3)2}.$$

where $v_2(t)$ is the output voltage waveform of the attenuator. However, because of the triaxial nature of $Zo_1$, $Zo_2$ and $Zo_3$, their impedances are related by $Zo_1 = \lambda\, Zo_2 + Zo_3$. Use of this relation simplifies the above to $$\frac{v_2(t)}{v_1(t)} = \frac{Zo_3}{Zo_1}.$$

OPERATION

In practice, a conventional picosecond pulse generator, for example, a tunnel diode (step function) generator is interconnected at the input to attenuator 10 a very fast oscilloscope (20 psec) is interconnected to the output of attenuator 10. An incident TEM pulse at the instant of arrival at the first transitional plane *a—a* (attenuating means) is split into two waves. One wave proceeds down intermediate conductor 26 while the other wavefront travels down outer conductor 32 for a distance $l_1$ until it reaches reflecting means 18 where it is blocked from catching up with the wavefront that went down intermediate conductor 26. Instead, the wave that travels down intermediate conductor 32 is inverted in sign, reversed in direction and sent back towards the source. However, on reaching the first transition plane *a—a* (attenuating means) again, part of the energy goes around the bend into intermediate conductor 26 and follows the first attenuated wavefront after being delayed by a time $T=2l_1/c$. The two separated wavefronts (T apart) finally arrive at the second transitional planes *c—c* where a phenomenon analogous to the one described at the first transitional plane occurs and both wavefronts then venture into output conductor 46 where output wave form 52 is viewed on the oscilloscope. The time delay between the two wavefronts can be used for absolutely time calibrating the pulse oscilloscope.

By utilizing a transition from one to two concentric coaxial transmission lines, I have invented an essentially perfect attenuator for pulses, i.e., an attenuator which does not vary with frequency, and as such, achieves accurate attenuation of pulse waveform (i.e., changing the amplitude of the waveform and not changing the shape.) I have also derived an accurate, simple and cheap method to time calibrate pulse instruments.

While the invention has been particularly shown and described with reference to the preferred embodiment thereof, it will be understood by those skilled in the art that the foregoing and other changes in form and detail may be made therein without departing from the spirit and scope of the invention:

What I claim is:

1. A device for attenuating short pulse waveforms in the picosecond domain comprising:

a. concentric coaxial transmission means, said coaxial transmission means comprising:

b. an outer conductor and an inner conductor having equal lengths;

c. a thin-walled intermediate conductor concentric with the inner conductor and substantially parallel with the outer conductor, said intermediate conductor having a first end forming a first transitional plane with the outer conductor and a second end forming a second transitional plane with said outer conductor, said transitional planes dividing the outer conductor into a plurality of transmission means and attenuating the pulse wave with minimum distortion to the wavefront; and d. a metal support means affixed to the inner walls of the outer conductor for reflecting the pulse waves in a direction opposite to the direction of travel and having a central opening for receiving and supporting the intermediate conductor.

2. A device for time calibrating pulse instruments comprising:

a. a coaxial transmission means, said coaxial transmission means having an inner conducting means and an outer conducting means;

b. a high conductivity metal support means having a central opening and affixed to the outer conducting means for reflecting a wavefront traveling perpendicular thereto;

c. a thin-walled intermediate conducting means concentric with the inner conducting means and passing through the opening in the metal support means, said intermediate conducting means forming a first and a second transitional plane with the outer conducting means for dividing a pulse wavefront passing therethrough into two wavvefronts with a minimum of distortion of the waveform shape;

d. A calibrating means formed by the distance from the first transitional plane to the metal support means along the outer conducting means; said calibrating means delaying the pulse wavefront propagating along the outer transmission means by a time proportional to the distance between the transition plane and the metal support means.

* * * * *